United States Patent [19]

Wilkinson

[11] Patent Number: 4,953,816

[45] Date of Patent: Sep. 4, 1990

[54] NURSING BOTTLE HOLDER

[76] Inventor: Eileen Wilkinson, 12 Webb Rd., Naugatuck, Conn. 06770

[21] Appl. No.: 299,782

[22] Filed: Jan. 19, 1989

[51] Int. Cl.[5] ..... A47D 15/00

[52] U.S. Cl. ..... 248/102; 297/482

[58] Field of Search ..... 248/102, 103, 105, 106, 248/176, 205.2; 2/49 R; D24/48; 446/73, 74, 369; 297/482, 250, 181

[56] References Cited

U.S. PATENT DOCUMENTS

| | | | |
|---|---|---|---|
| D. 141,700 | 6/1945 | Raport | D24/4 B |
| D. 153,937 | 5/1949 | Graboi | D24/4 B |
| D. 160,192 | 9/1950 | Miller | D24/4 B |
| 1,778,545 | 10/1930 | Allen | 248/102 |
| 2,711,052 | 6/1955 | Brayford | 248/102 |
| 2,838,758 | 6/1958 | Townley | 2/49 R |
| 4,121,797 | 10/1978 | MacNeil . | |
| 4,227,270 | 10/1980 | Rivera | 248/102 |
| 4,315,654 | 2/1982 | Crook . | |
| 4,405,106 | 9/1983 | Adler . | |
| 4,473,907 | 10/1984 | Maillard . | |
| 4,498,613 | 2/1985 | Donahue . | |
| 4,564,957 | 1/1986 | Scharf . | |
| 4,630,793 | 12/1986 | Hunter . | |
| 4,639,946 | 2/1987 | Koenig . | |
| 4,695,092 | 9/1987 | Hittie | 297/250 |
| 4,718,623 | 1/1988 | McClure | 248/205.2 |
| 4,776,546 | 10/1988 | Goldson | 248/102 |

FOREIGN PATENT DOCUMENTS

| | | | |
|---|---|---|---|
| 2342188 | 9/1977 | France | 297/482 |
| 560531 | 4/1975 | Switzerland | 297/250 |

*Primary Examiner*—Ramon O. Ramirez
*Assistant Examiner*—Robert A. Olson
*Attorney, Agent, or Firm*—McCormick, Paulding & Huber

[57] ABSTRACT

A bottle holder for a vehicle safety seat having a restraining device for releasably retaining an infant in a seated position comprises a substantially planar, soft, resilient, flexible pad and means for releasably securing the pad to the restraining device in front of a seated infant. The pad has a chest shielding portion for covering the frontal profile of the infant's chest. A pair of laterally spaced apart upwardly projecting portions of the pad define an upwardly open bottle receiving yoke for cradlingly supporting and frictionally retaining a nursing bottle. A design imprinted on the frontal surface of the bottle holder comprises a fanciful animal figure having ears defined by the upwardly projecting portions.

12 Claims, 2 Drawing Sheets

NURSING BOTTLE HOLDER

BACKGROUND OF THE INVENTION

This invention relates in general to nursing bottle holders and deals more particularly with an improved bottle holder for use with an infant safety seat of the type carried in a motor vehicle and having a restraining device for releasably securing an infant in properly seated position.

Heretofore various nursing bottle holders have been provided for use with infant safety seats and typical examples of such devices are found in U.S. Pat. Nos. 4,121,797 to MacNeil, issued Oct. 28, 1978; and 4,315,654 to Crook, issued Feb. 16, 1982. However, such bottle holders of rigid construction present a potential source of injury to a child seated in a vehicle in the event the vehicle stops suddenly or becomes involved in a traffic accident. Further, if the device provides rigid support for a bottle, the bottle itself may become a source of potential injury to the seated child in such an emergency situation.

Accordingly, it is the general aim of the present invention to provide an improved nursing bottle holder for an infant safety seat and which is of non-rigid construction for supporting a nursing bottle in comfortable feeding position while allowing for free release of the bottle in the event of a vehicle emergency. A further aim of the present invention is to provide an improved nursing bottle holder for use with a vehicle seat and which is generally anatomically contoured to partially protect a seated infant from being struck by a lightweight flying object, such as a loose item within a vehicle, which may become airborne in the event that the vehicle stops suddenly or is involved in a traffic accident.

SUMMARY OF THE INVENTION

In accordance with the present invention an improved nursing bottle holder is provided for use with an infant safety seat having restraining means for releasably securing a child in properly seated position thereon. The bottle holder essentially comprises a soft, resilient, flexible, pad and means for releasably attaching the pad to a restraining means, such as aforesaid, in front of an infant releasably secured in seated position o the safety seat by the restraining means.

The pad has a chest shielding portion for substantially covering or shielding the frontal profile of the seated infant's chest. The pad also has means for supporting a nursing bottle in a nursing position relative to the seated infant and which includes a pair of laterally spaced apart upwardly projecting portions which define an upwardly open bottle receiving yoke for cradlingly supporting and frictionally engaging opposite sides of a nursing bottle received therein with the longitudinal axis of the bottle extending in a transverse direction relative to the plane of the pad.

DETAILED DESCRIPTION OF PREFERRED EMBODIMENT

Figure 1:
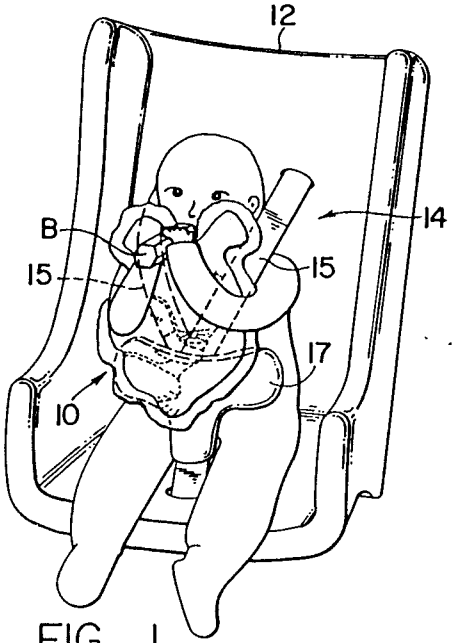
FIG. 1 is a perspective view showing a child restrained in seated position on a vehicle safety seat provided with a nursing bottle holder embodying the present invention.

Turning now to the drawings, a nursing bottle holder embodying the present invention is indicated generally by the reference numeral 10. The illustrated bottle holder 10 is particularly adapted for use with an infant safety seat of the type carried in a motor vehicle and having a restraining device for releasably securing an infant in a properly seated position thereon. In FIG. 1 the bottle holder 10 is shown in a bottle supporting position relative to a seated infant releasably secured in seated position on a vehicle safety seat 12 by a restraining device designated generally by the numeral 14, the infant's bottle being indicated by the letter B. The restraining device may take various forms and may, for example, comprise conventional adjustable safety belts or straps 15,15 and may also include a rigid restraining member such as indicated at 17 for use in combination with straps to releasably secure the child in seated position, as shown in FIG. 1. The illustrated bottle holder 10 is releasably attached to the restraining device 14 in a manner to be hereinafter more fully described.

Figure 2:
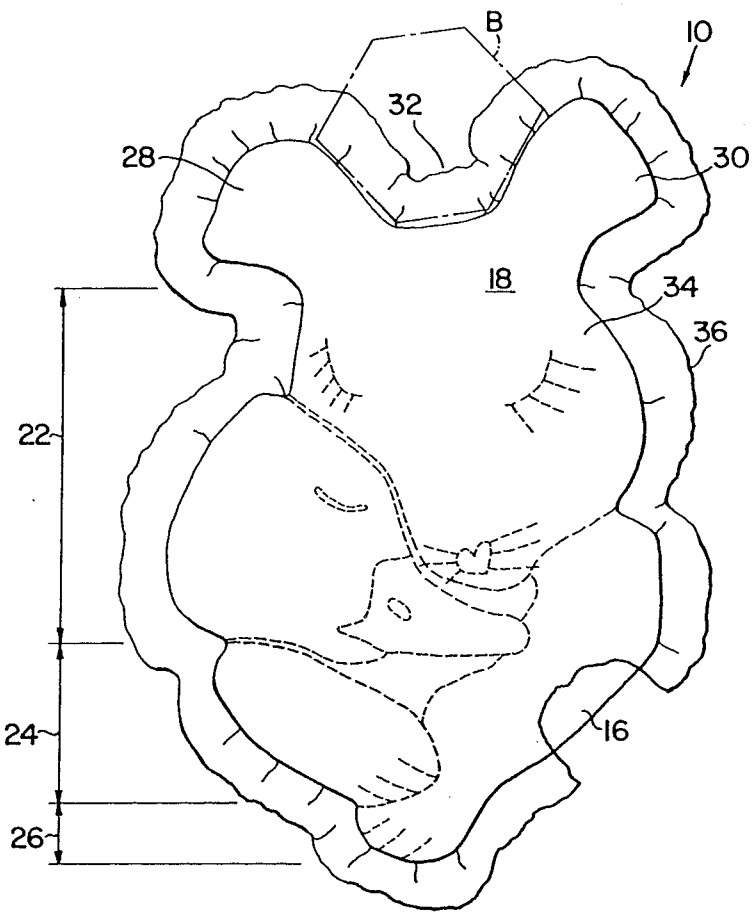
FIG. 2 is a somewhat enlarged front view of the nursing bottle holder shown in FIG. 1.
Figure 4:
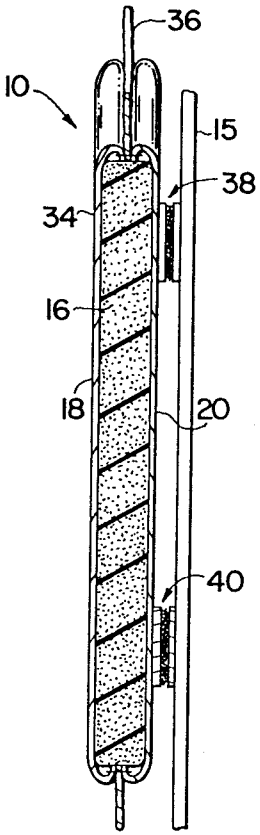
FIG. 4 is a sectional view taken along the line 4—4 of FIG. 3.
Figure 3:
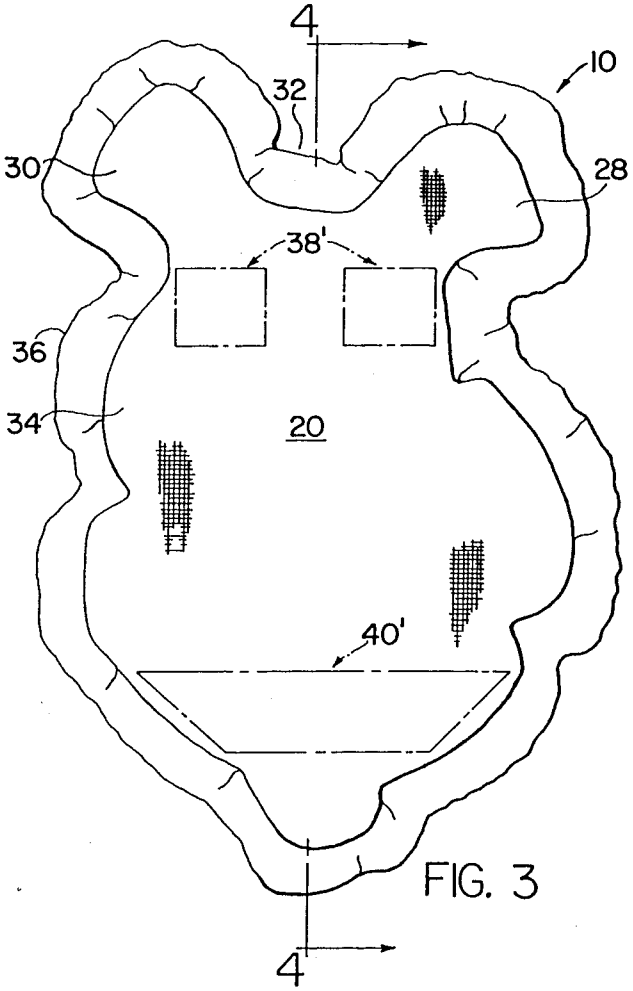
FIG. 3 is a rear view of the nursing bottle holder.

Considering now the nursing bottle holder 10 in further detail, and referring particularly to FIGS. 2–4, the bottle holder essentially comprises a substantially flat or planar pad 16 preferably made from soft, resilient, flexible impact absorbent material such as sponge rubber, foamed plastic, fiber flock or like material. The illustrated pad 16 has a substantially uniform thickness and is generally anatomically contoured, as viewed from the front and as shown in FIG. 2. Specifically, the pad has front and rear surfaces 18 and 20 and includes a chest shielding portion indicated by the numeral 22 for positioning in front of an infant seated on the safety seat 12 to substantially cover or shield the frontal profile of the infant's chest.

The illustrated pad 12 further includes an abdominal shielding portion designated by the numeral 24, which depends from the chest shielding portion 22, and a genital shielding portion 26 which depends centrally from the abdominal shielding portion 24.

A pair of laterally spaced apart upwardly projecting portions of the pad, indicated at 28 and 30, extend from the chest shielding portion and define an upwardly open bottle receiving yoke 32 for cradlingly supporting and frictionally engaging opposite side portions of a nursing bottle received therebetween with the longitudinal axis of the bottle extending in a generally transverse direction relative to the plane of the pad and for frictionally engaging the bottle at opposite sides of its axis, as shown in FIG. 2 where the bottle B is shown in broken lines.

Preferably, and as shown, the pad 16 is contained within a protective cover 34 which substantially complements or conforms to the shape of the pad. The cover may be made from any suitable flexible material, but preferably it is made from a durable, washable material such as a washable fabric or plastic sheet material, which may be easily wiped clean when soiled. The illustrated device 10 has a soft washable sewn on cotton fabric cover 34 which includes a decorative ruffle 36 extending around its periphery.

The frontal surface of the bottle holder 10 is preferably decorated With a fanciful animal design, the animal having ears formed by the yoke defining portions 28 and 30. The decorative design may be applied directly to the frontal surface of the pad if the device does not include a cover. However, in the present instance, the design is applied to the cover 34 and, as shown, comprises a fanciful floppy eared rabbit cuddling a duck.

The bottle holder 10 may be releasably secured to the restraining device by any suitable arrangement of releasable fasteners. However, in the presently preferred embodiment of the invention shown in the drawings, a plurality of VELCRO fasteners indicated generally at 38,38 and 40 are employed for this purpose, since such fasteners can easily be attached to the bottle holder 10 in positions required to releasably secure the bottle holder to an associated restraining device. Thus, the bottle holder 10 may be readily adapted for use with vehicle safety seats having restraining devices of differing types.

Each VELCRO fastener comprises a patch or strip of fastening material which includes a pair of connected mating components. One component carries J-hooks and the other component has loops or eyes which cooperate with the J-hooks to releasably retain the two mating fastener components in connected engagement with each other, in a manner well known in the fastener art.

Each VELCRO fastener component has a coating of pressure sensitive adhesive on one surface thereof. Prior to attaching the bottle holder to the restraining device, the pressure sensitive adhesive on each VELCRO component is covered by strip of releasable backing material (not shown). When the bottle holder 10 is assembled with a vehicle safety seat such as the seat 12, one of the components of each pair is adhesively attached to the restraining device 14 and the other of the components comprising the pair is attached to the bottle holder or, more specifically, to the rear surface of the protective cover 34. Typical locations for VELCRO attachment to the rear surface of the protective cover 34 are indicated by broken lines in FIG. 3 and designated by the numerals 38', 38' and 40'.

Preparatory to first using of the device, the child is seated in proper position on the vehicle safety seat 12 and the restraining device 14 is secured to releasably retain the child in the latter position. The releasable backing material is then stripped from one of the VELCRO fastener components comprising each pair of connected component and the component from which the backing material has been stripped is preferably first adhesively secured to an associated one of the straps 15,15 which comprises the restraining device 14. The procedure is repeated to secure one or more additional VELCRO fasteners at other selected positions on the restraining device 14. Thereafter, the releasable backing material is stripped from the other of the VELCRO components comprising each connected pair of components attached to the restraining device to expos the pressure sensitive adhesive thereon and the bottle holding device 10 is carefully placed in proper bottle holding position and pressed into adhering engagement with the exposed adhesive surfaces on the various pairs of VELCRO components attached to the restraining device 14 . Since the pressure sensitive adhesive on the VELCRO has a greater affinity for the surface to which it is attached than the mating VELCRO components have for each other, the bottle holder 10 may be easily stripped or removed from connected engagement with the restraining device 14 by separating the mating VELCRO components after the VELCRO fasteners have been attached to the restraining device and to the bottle holder. Thereafter, the bottle holder 10 may be resecured to the vehicle safety seat 12 each time the sea is used by merely bringing the mating VELCRO components into connecting engagement with each other.

When properly assembled with the restraining device, the bottle holder 10 will support a nursing bottle in a comfortable feeding position relative to a seated infant. Since the nursing bottle is merely cradled and frictionally retained by the device, in the event of emergency, such as a sudden stop or traffic accident involving the vehicle, the bottle is free to fall from the device.

Although the bottle holder 10 is not specifically intended to be a protective device, it does offer some degree of shielding protection for the infant and ma prevent the infant from being struck or injured by a lightweight item loosely stored in the vehicle passenger compartment which may become airborne in the event of sudden braking of the vehicle.

I claim:

1. The combination comprising an infant safety seat having restraining means for releasably securing an infant in seated position thereon, a nursing bottle holder including a soft resilient flexible pad having front and rear surfaces, and fastening means for releasably attaching said pad to the restraining means in a bottle supporting position in front of an infant releasably secured in seated position on the safety seat by the restraining means and including one fastener component attached to said rear surface and a mating fastener component attached to said restraining means for connecting engagement with said one fastener component, said pad including a chest shielding portion for substantially covering the frontal profile of the seated infant's chest when the pad is in its bottle supporting position, said pad having means for supporting a nursing bottle in a nursing position relative to the seated infant and including a pair of laterally spaced apart and upwardly projecting bottle retaining portions extending from the upper end of said chest shielding portion, said bottle retaining portions defining an upwardly open bottle receiving yoke for cradlingly supporting a nursing bottle received therein in a nursing position with the longitudinal axis of the nursing bottle extending in a transverse direction relative to the plane of the pad when the pad is in its bottle supporting position, said bottle retaining portions frictionally engaging associated opposite side portions of a nursing bottle such as aforesaid cradled within said yoke.

2. The combination comprising an infant safety seat having safety strap means for releasably securing an infant in seated position on said safety seat, and a nursing bottle holder including a soft resilient flexible pad, said pad having front and rear surfaces and including a chest shielding portion positioned in front of an infant seated on said safety seat and substantially covering the frontal profile of the seated infant's chest, said pad having means for supporting a nursing bottle in a nursing position relative to the seated infant and including a pair of laterally spaced apart and upwardly projecting bottle retaining portions extending from the upper end of said chest shielding portion, said bottle retaining portions defining an upwardly open bottle receiving yoke for cradlingly supporting a nursing bottle received therein with the longitudinal axis of the nursing bottle extending in a transverse direction relative to the plane of the pad and frictionally engaging associated opposite side portions of the nursing bottle, and fastening means for releasably attaching the pad to said safety strap means in front of an infant seated on said safety seat and including a pair of mating fastener components, one of said components being attached to said rear surface of said pad and other of said components being attached to said safety strap means.

3. The combination as set forth in claim 2 wherein said front surface has a fanciful animal design thereon and said upwardly projecting portions define the ears of said animal design.

4. The combination as set forth in claim 3 wherein said animal design comprises a fanciful rabbit.

5. The combination as set forth in claim 2 wherein one of said mating components carries J-hooks and the other of said components carries a multiplicity of loops for cooperative holding engagement with said J-Hooks.

6. The combination as set forth in claim 5 wherein said fastening means comprises VELCRO.

7. The combination as set forth in claim 2 wherein said pad is further characterized as a substantially planar pad of substantially uniform thickness.

8. The combination as set forth in claim 7 wherein said pad includes a protective cover and said cover defines said front and rear surfaces.

9. The combination as set forth in claim 7 wherein said pad has an abdominal shielding portion integrally connected to and depending from the lower end of said chest shielding portion for covering the frontal profile of the seated infant's abdomen.

10. The combination as set forth in claim 9 wherein said pad includes a genital shielding portion integrally connected to and depending centrally from the lower end of said abdominal shielding portion for covering the frontal profile of the seated infant's genital region.

11. The combination comprising nursing bottle holder and an infant's seat having restraining strap means for releasably securing an infant in seated position thereon, said nursing bottle holder including a pad assembly having a front surface and a rear surface and including soft resilient flexible substantially planar pad of substantially uniform thickness, a cover received on said pad and substantially complementing said pad, and fastening means comprising VELCRO components on said rear surface and on said restraining strap means releasably attaching said pad assembly to said restraining strap means in front of an infant releasably secured in seated position on the safety seat by said restraining strap means, said pad assembly having a chest shielding portion substantially covering the frontal profile of the infant's chest, an abdominal shielding portion depending from said chest shielding portion and covering the frontal profile of the infant's abdomen, and a genital shielding portion centrally depending from said abdominal shielding portion and covering the frontal profile of the infant's genital region, said pad assembly having a pair of laterally spaced apart and upwardly projecting bottle retaining portions extending from the upper end of said chest shielding portion and defining an upwardly open bottle receiving yoke for frictionally engaging and cradling supporting a nursing bottle received within said yoke with the longitudinal axis of the nursing bottle extending in a transverse direction relative to the plane of said pad assembly.

12. The combination as set forth in claim 11 wherein said VELCRO is adhesively attached to said rear surface.

* * * * *